US008714231B2

(12) United States Patent
Chiang et al.

(10) Patent No.: US 8,714,231 B2
(45) Date of Patent: May 6, 2014

(54) ALUMINUM-AND-AMORPHOUS ALLOY COMPOSITE AND METHOD FOR MANUFACTURING

(75) Inventors: Huann-Wu Chiang, New Taipei (TW); Cheng-Shi Chen, New Taipei (TW); Shun-Mao Lin, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 230 days.

(21) Appl. No.: 13/282,242

(22) Filed: Oct. 26, 2011

(65) Prior Publication Data

US 2013/0037177 A1 Feb. 14, 2013

(30) Foreign Application Priority Data

Aug. 11, 2011 (CN) ..... 201110229903.3

(51) Int. Cl.

| | |
|---|---|
| ***B22D 19/08*** | (2006.01) |
| ***B22D 19/00*** | (2006.01) |
| ***B22D 17/24*** | (2006.01) |

(52) U.S. Cl.

CPC ..... *B22D 19/08* (2013.01); *B22D 19/00* (2013.01); *B22D 17/24* (2013.01)

USPC ..... 164/75; 164/91; 164/113

(58) Field of Classification Search

CPC ..... B22D 19/00; B22D 19/08; B22D 25/02; B22D 25/06

USPC ..... 164/75, 91, 113

See application file for complete search history.

(56) References Cited

U.S. PATENT DOCUMENTS

| | | | | |
|---|---|---|---|---|
| 5,711,363 | A * | 1/1998 | Scruggs et al. | 164/113 |
| 2012/0231294 | A1 * | 9/2012 | Chang et al. | 428/660 |
| 2013/0150230 | A1 * | 6/2013 | Taylor et al. | 502/1 |

* cited by examiner

*Primary Examiner* — Kevin P Kerns
*Assistant Examiner* — Kevin E Yoon
(74) *Attorney, Agent, or Firm* — Novak Druce Connolly Bove + Quigg LLP

(57) ABSTRACT

An aluminum-and-amorphous alloy composite includes an aluminum part and an amorphous alloy part. The aluminum part has an aluminum oxide film formed on a surface thereof. The aluminum oxide film defines nano-pores. The amorphous alloy part is integrally bonded to the surface of the aluminum part having the aluminum oxide film. A method for manufacturing the composite is also described.

10 Claims, 4 Drawing Sheets

ALUMINUM-AND-AMORPHOUS ALLOY COMPOSITE AND METHOD FOR MANUFACTURING

CROSS-REFERENCE TO RELATED APPLICATIONS

This application is one of the two related co-pending U.S. patent applications listed below. All listed applications have the same assignee. The disclosure of each of the listed applications is incorporated by reference into another listed application.

| . | Title | Inventors |
|---|---|---|
| 13/282,242 | ALUMINUM-AND-AMORPHOUS ALLOY COMPOSITE AND METHOD FOR MANUFACTURING | HUANN-WU CHIANG et al. |
| 13/282,246 | STAINLESS STEEL-AND-AMORPHOUS ALLOY COMPOSITE AND METHOD FOR MANUFACTURING | HUANN-WU CHIANG et al. |

BACKGROUND

1. Technical Field

The present disclosure generally relates to a composite of aluminum or aluminum alloy and amorphous alloy and a method for manufacturing the composite.

2. Description of Related Art

Due to having good properties such as high mechanical strength, high abrasion resistance, and good corrosion resistance, amorphous alloy may be joined with other metals to be used on electronic devices. Welding and adhesive bonding are two typical joining methods. However, the heat during the welding can produce a crystallization of the amorphous alloy, thus negatively affecting the welding. The adhesive bonding may only achieve a low adhesive strength of about 0.5 MPa between the amorphous alloy and the aluminum alloy. Moreover, restricted by the chemical durability of the adhesive material, bonded amorphous alloy and aluminum alloy can be only used within a narrow temperature range of about −50° C. to about 100° C., which means they are not suitable in applications where operating or environmental temperatures may fall outside the range.

Therefore, there is room for improvement within the art.

BRIEF DESCRIPTION OF THE FIGURES

Many aspects of the disclosure can be better understood with reference to the following figures. The components in the figures are not necessarily drawn to scale, the emphasis instead being placed upon clearly illustrating the principles of the disclosure. Moreover, in the drawings like reference numerals designate corresponding parts throughout the views.

DETAILED DESCRIPTION

Figure 1:
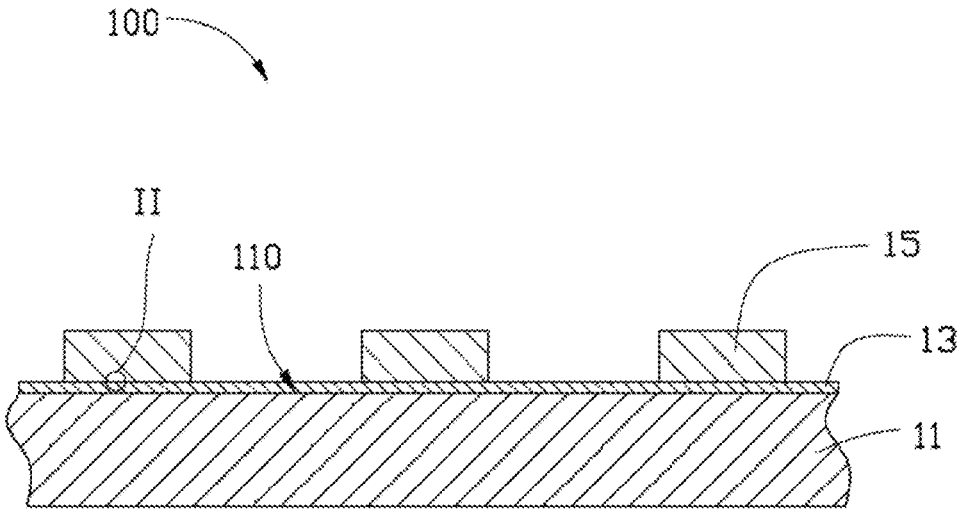
FIG. 1 is a cross-sectional view of an exemplary embodiment of an aluminum-and-amorphous alloy composite.

FIG. 1 shows an aluminum-and-amorphous alloy composite 100 according to an exemplary embodiment. The aluminum-and-amorphous alloy composite 100 includes an aluminum part 11, and amorphous alloy parts 15 integrally formed on the aluminum part 11.

The aluminum part 11 can be made of aluminum or aluminum alloy.

Figure 2:
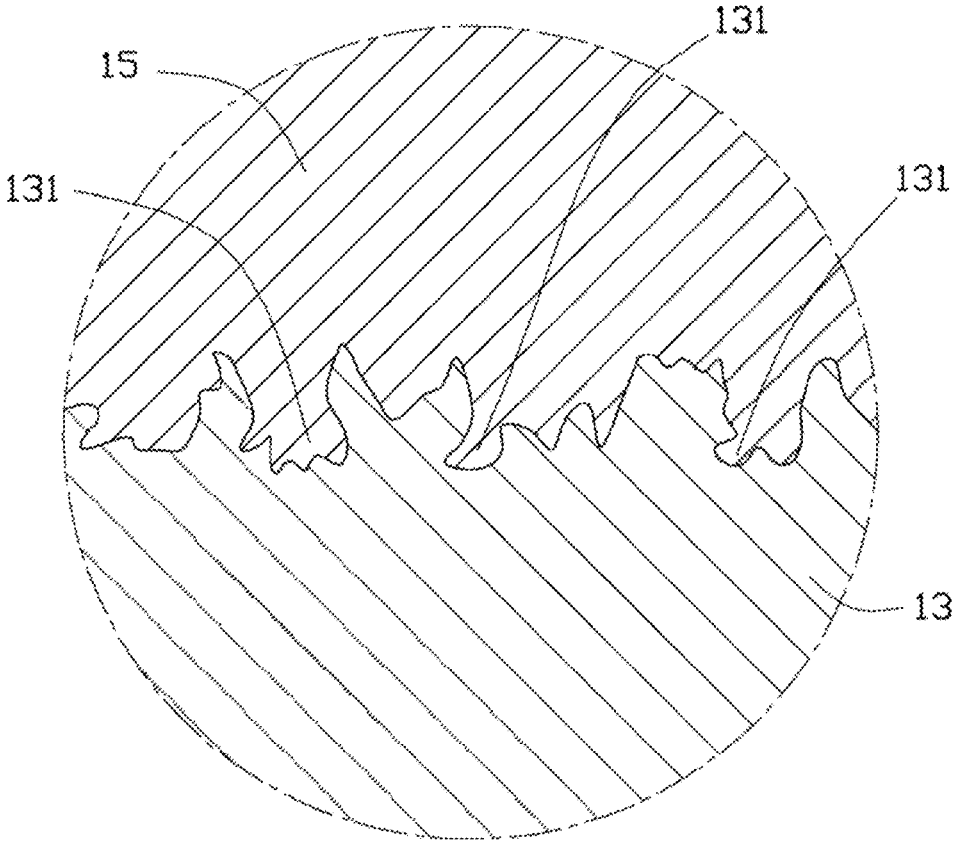
FIG. 2 is an enlarged schematic view of a circled portion II of FIG. 1.

The aluminum part 11 has an aluminum oxide film 13 formed on a surface 110 thereof. Referring to FIG. 2, the aluminum oxide film 13 defines a plurality of nano-pores 131. The nano-pores 131 may be uniformly formed on the surface of the aluminum oxide film 13 (see FIG. 3). The nano-pores 131 may have an average diameter of about 30 nanometers (nm) to about 60 nm. The aluminum oxide film 13 substantially comprises aluminum oxide resulted from an anodizing process applied to the aluminum part 11.

The amorphous alloy parts 15 may be bonded to the aluminum part 11 by injection molding, with portions of the amorphous alloy parts 15 penetrating in the nano-pores 131 (see FIG. 2). The amorphous alloy parts 15 may be made of a magnesium-based amorphous alloy, which has a supercooled liquid region ($\Delta T$) larger than 20° C. The term "supercooled liquid region" is defined as the difference (Tx−Tg) between the onset temperature of glass transition (Tg) and the onset temperature of crystallization (Tx) of an alloy. The value of $\Delta T$ is a measure of the amorphous phase-forming ability of the alloy. The onset temperature of crystallization of the magnesium-based amorphous alloy is lower than 300° C.

A method for manufacturing the composite 100 may include the following steps:

The aluminum part 11 is provided. The aluminum part 11 may be formed by punching to obtain a desired shape.

The aluminum part 11 is pretreated. The pretreatment may include dipping the aluminum part 11 in a degreasing agent to remove impurities such as grease or dirt from the aluminum part 11. Then, the aluminum part 11 is activated by dipping the aluminum part 11 in an alkaline solution, removing the natural oxide formed on the surface of the aluminum part 11.

The aluminum part 11 is anodized to form the aluminum oxide film 13 defining the nano-pores 131. The anodizing process may be carried out in an electrolyte containing sulfuric acid, with the aluminum part 11 being an anode, and a titanium board being a cathode. The sulfuric acid may have a weight percentage of about 10%-15% within the electrolyte. An electric current density about 1.8 ampere per square decimeter ($A/dm^2$)-2 $A/dm^2$ is applied between the anode and the cathode. The electrolyte maintains a temperature of no more than 30° C. during the anodizing. Anodizing the aluminum part 11 may take about 4 min-6 min. Then, the aluminum part 11 is rinsed in water and then dried.

Figure 3:
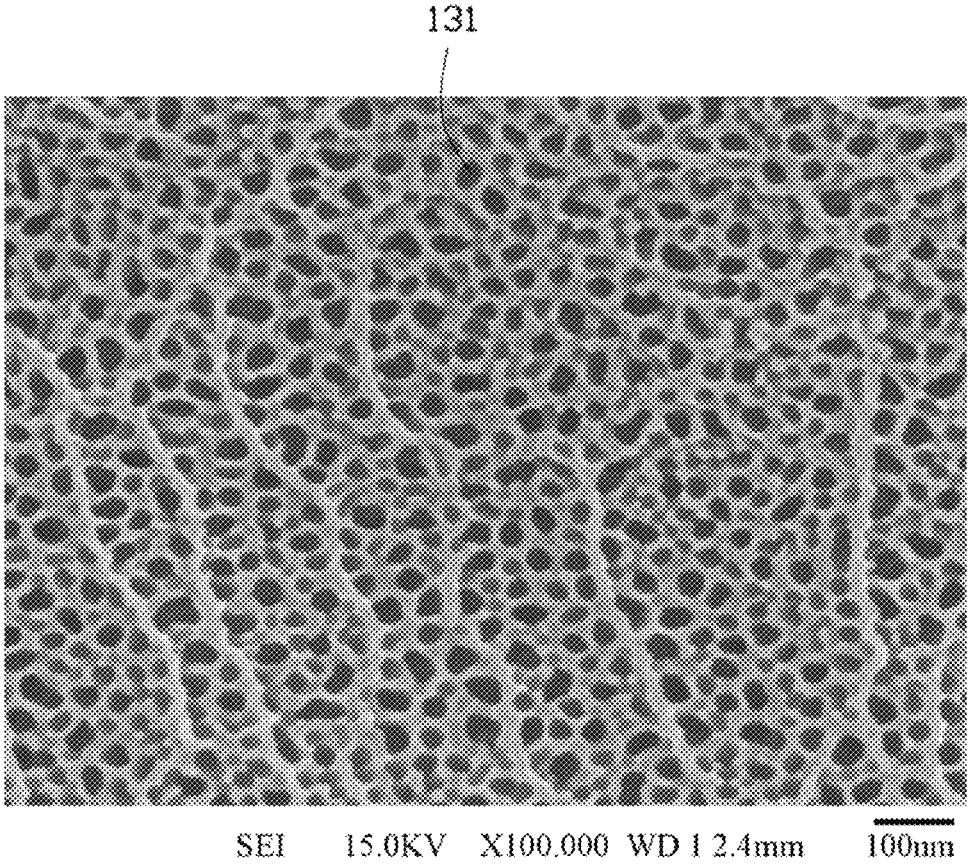
FIG. 3 is a scanning electron microscopy view of an exemplary embodiment of the anodized aluminum part.

Referring to FIG. 3, the anodized aluminum part 11 is observed using a field emission scanning electronic microscope, such as a JSM-6700F type microscope sold by JEOL Ltd. The observation shows that the aluminum oxide film 13 is formed on the aluminum part 11. The aluminum oxide film 13 defines a plurality of irregular nano-pores 131. The nano-pores 131 have an average diameter of about 30 nm-60 nm.

The aluminum part 11 with the aluminum oxide film 13 is pre-heated to the onset temperature of glass transition (Tg) of the magnesium-based amorphous alloy for the amorphous alloy parts 15. The pre-heating step may help the magnesium-based amorphous alloy for the amorphous alloy parts 15 easily flow into the nano-pores 131 during the subsequent injection molding step. Also, the pre-heating step may further remove the water remained in the nano-pores 131, enhancing the bonding between the aluminum part 11 and the amorphous alloy parts 15. The pre-heating step may be implemented in an oven.

Figure 4:
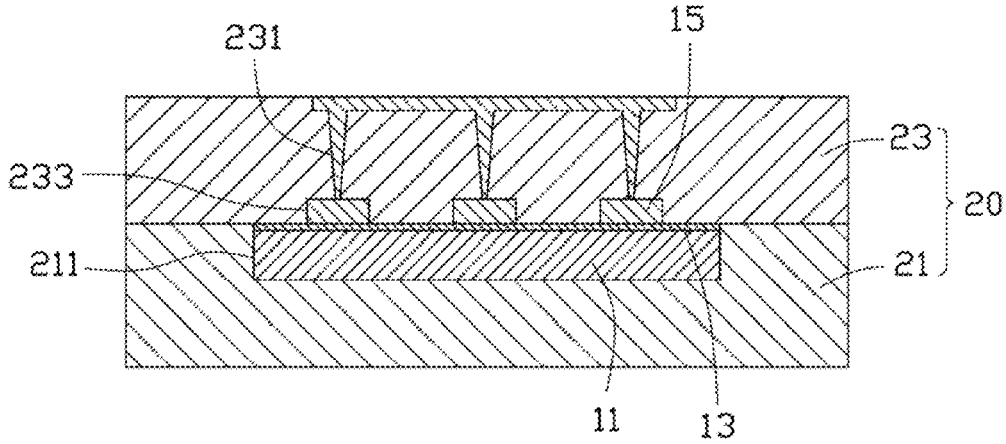
FIG. 4 is a cross-sectional view of molding the composite shown in FIG. 1.

Referring to FIG. 4, an injection mold 20 is provided. The injection mold 20 includes a core insert 23 and a cavity insert 21. The core insert 23 defines gates 231, and first cavities 233. The cavity insert 21 defines a second cavity 211 for receiving the aluminum part 11. The pre-heated aluminum part 11 is located in the second cavity 211. Inert gas, such as argon is fed into the injection mold 20, and molten magnesium-based amorphous alloy is injected through the gates 231 to coat the surface of the aluminum part 11 and fill the nano-pores 131, and finally fill the first cavities 233 to form the amorphous alloy parts 15, as such, the composite 100 is formed. The molten magnesium-based amorphous alloy may be at a temperature of about (Tg+5)° C. to about (Tx−10)° C. During the molding process, the injection mold 20 may be at a temperature of about (Tg+5)° C. to about (Tx−5)° C.

Amorphous alloy at a temperature between the Tg and Tx of the amorphous alloy may be very sensitive to oxidizing atmosphere and oxidized to formed a ceramic film on the surface thereof. Thus, inert gas may be fed into to the injection mold 20 as a protecting gas. The onset temperature of crystallization of the magnesium-based amorphous alloy is lower than 300° C., preventing the mechanical property of the aluminum part 11 from damages.

One example of manufacturing the composite 100 is described as follows. The pre-treating step in the specific example may be substantially the same as described above so it is not described here again.

EXAMPLE

An aluminum part 11 made of a 5052-H112 type aluminum alloy is provided.

Anodizing the aluminum part 11: the electrolyte containing sulfuric acid at a weight percentage of 10%; the temperature of the electrolyte is maintained below 30° C.; the electric current density applied is 2 A/dm$^2$; the anodizing takes 5 min.

Pre-heating the aluminum part 11: the aluminum part 11 is pre-heated at a temperature of 157° C.

Injection magnesium-based amorphous alloy to form the amorphous alloy parts 15: the magnesium-based amorphous alloy is a magnesium-based amorphous alloy containing copper at an atomic percentage of 30%, dysprosium at an atomic percentage of 11.5%, and the remainder magnesium; the magnesium-based amorphous alloy is heated to a temperature of about 165° C.-210° C. and injection molded to form the amorphous alloy parts 15.

Furthermore, the shear strength of the composite 100 has been tested. A universal material testing machine sold by INSTRON Ltd may be used. The tests indicate that the shear strength of the composite 100 is about 70 MPa. Furthermore, the composite 100 has been subjected to a temperature humidity bias test (72 hours, 85° C., relative humidity: 85%) and a thermal shock test (48 hours, −40° C. to 85° C., 4 hours/cycle, 12 cycles total), such testing did not result in decreased tensile or shear strengths of the composite 100.

It is believed that the exemplary embodiment and its advantages will be understood from the foregoing description, and it will be apparent that various changes may be made thereto without departing from the spirit and scope of the disclosure or sacrificing all of its advantages, the examples hereinbefore described merely being preferred or exemplary embodiment of the disclosure.

What is claimed is:

1. A method for making an aluminum-and-amorphous alloy composite, comprising:

providing an aluminum part;

anodizing the aluminum part to form an aluminum oxide film defining nano-pores;

pre-heating the aluminum part;

positioning the aluminum part in a mold; and molding molten amorphous alloy on the aluminum oxide film to form an amorphous alloy part integrally bonded to the aluminum part when hardened, the molten amorphous alloy being at a temperature of about (Tg+5)° C. to about (Tx−10)° C., wherein the Tg and Tx are the onset temperature of glass transition and the onset temperature of crystallization of the amorphous alloy respectively.

2. The method as claimed in claim 1, wherein anodizing the aluminum part is carried out in an electrolyte containing sulfuric acid.

3. The method as claimed in claim 2, wherein the sulfuric acid has a weight percentage of about 10%-15%.

4. The method as claimed in claim 3, wherein during the anodizing step, an electric current density about 1.8 A/dm$^2$-2 A/dm$^2$ is applied to the aluminum part for about 4 min-6 min; the electrolyte maintains a temperature of no more than 30° C.

5. The method as claimed in claim 1, wherein during the pre-heating step, the aluminum part is heated to the onset temperature of glass transition of the magnesium-based amorphous alloy.

6. The method as claimed in claim 1, wherein during the molding step, inert gas is fed into the mold.

7. The method as claimed in claim 1, wherein during the molding step, the mold is at a temperature of about (Tg+5)° C. to about (Tx−5)° C.

8. The method as claimed in claim 1, further comprising a step of activating the aluminum part by dipping the aluminum part in an alkaline solution, removing natural oxide formed on the aluminum part before the anodizing step.

9. The method as claimed in claim 1, further comprising a step of degreasing the aluminum part before the step of activating the aluminum part.

10. A method for making an aluminum-and-amorphous alloy composite, comprising:

providing an aluminum part;

anodizing the aluminum part to form an aluminum oxide film, the aluminum oxide film defining nano-pores having an average diameter of about 30 nm-60 nm;

pre-heating the aluminum part;

positioning the aluminum part in a mold; and injecting molten magnesium-based amorphous alloy on the aluminum oxide film to form an amorphous alloy part integrally bonded to the aluminum part when hardened, the molten magnesium-based amorphous alloy being at a temperature of about (Tg+5)° C. to about (Tx−10)° C., wherein the Tg and Tx are the onset temperature of glass transition and the onset temperature of crystallization of the magnesium-based amorphous alloy respectively, and the difference between the Tx and the Tg is larger than 20° C.

* * * * *